US011043369B2

(12) United States Patent
Kuramoto et al.

(10) Patent No.: US 11,043,369 B2
(45) Date of Patent: Jun. 22, 2021

(54) SAMPLE ANALYZER AND SAMPLE ANALYSIS METHOD

(71) Applicant: TOSHIBA MEMORY CORPORATION, Tokyo (JP)

(72) Inventors: Akira Kuramoto, Kuwana Mie (JP); Teruyuki Kinno, Yokkaichi Mie (JP)

(73) Assignee: TOSHIBA MEMORY CORPORATION, Tokyo (JP)

( * ) Notice: Subject to any disclaimer, the term of this patent is extended or adjusted under 35 U.S.C. 154(b) by 369 days.

(21) Appl. No.: 16/113,920

(22) Filed: Aug. 27, 2018

(65) Prior Publication Data

US 2019/0279855 A1 Sep. 12, 2019

(30) Foreign Application Priority Data

Mar. 12, 2018 (JP) ..... JP2018-044494

(51) Int. Cl.
*H01J 49/16* (2006.01)

(52) U.S. Cl.
CPC ..... *H01J 49/161* (2013.01)

(58) Field of Classification Search
CPC ..... G01N 23/22; H01J 37/20; H01J 37/226; H01J 37/285; H01J 37/244; H01J 37/317; H01J 37/3045
See application file for complete search history.

(56) References Cited

U.S. PATENT DOCUMENTS

2010/0116985 A1* 5/2010 Bunton ..... G01N 23/22 250/307
2012/0080596 A1 4/2012 Vandervorst
2015/0060695 A1 3/2015 Man et al.

FOREIGN PATENT DOCUMENTS

JP 2012-73242 A 4/2012

* cited by examiner

*Primary Examiner* — David E Smith
*Assistant Examiner* — Hsien C Tsai
(74) *Attorney, Agent, or Firm* — Foley & Lardner LLP

(57) ABSTRACT

A sample analyzer includes a voltage source that applies a voltage to a sample. A laser irradiator irradiates the sample with a laser beam. A detector detects a particle emitted from the sample. An operation device specifies the material of the particle detected by the detection device, by mass spectrometry of the particle and analyzes the structure of the sample. The operation device calculates a ratio in structure between model information indicating the structure of the sample, which is prepared in advance, and analysis information indicating the structure of the sample, which is obtained by the mass spectrometry, and applies the ratio to the analysis information so as to correct the analysis information.

14 Claims, 16 Drawing Sheets

SAMPLE ANALYZER AND SAMPLE ANALYSIS METHOD

CROSS-REFERENCE TO RELATED APPLICATIONS

This application claims the benefit of and priority to Japanese Patent Application No. 2018-044494, filed Mar. 12, 2018, the entire contents of which are incorporated herein by reference.

FIELD

Embodiments described herein relate generally to a sample analyzer and a sample analysis method.

BACKGROUND

An atomic probe device can be used as an analysis device at the nanometer level or the atomic level. The atomic probe device can specify the material of a sample by applying a high voltage to a needle-like sharpened sample and performing mass spectrometry of ions field-evaporating from the tip portion of the sample. A laser atomic probe device can induce field evaporation by irradiating the tip portion of a sample with a laser beam. Such an atomic probe device can analyze the structure of the tip of a sample in three dimensions.

DETAILED DESCRIPTION

In a case where a tip portion of a sample includes a plurality of materials having different electrical fields (e.g., evaporation field) when performing field evaporation, the sample may not be uniformly evaporated due to the difference of the evaporation field, and the shape of the tip portion may be distorted from a hemispherical shape. In such a case, in three-dimensional reconstruction processing using measurement data, if three-dimensional reconstruction is performed on the premise that the tip of a sample is hemispherical, reconstructing the structure of the sample with accuracy is not possible.

Moreover, since irradiation with a laser beam is performed from one side of the sample, field evaporation easily occurs from a laser irradiation surface, but field evaporation occurs less from an opposite side of the laser irradiation surface. Thus, the laser irradiation surface of the sample is smoothened, and thus, the tip shape of the sample is deformed from the hemispherical shape. Such deformation of the tip shape of the sample hinders accurate analysis of the structure of the tip of the sample, which is called "local magnification effect."

In the present disclosure, embodiments provides a sample analyzer and a sample analysis method in which it is possible to accurately analyze the structure of a sample by using field evaporation even when the tip shape of the sample deforms, and to prevent deformation of the tip shape of the sample.

According to one embodiment, a sample analyzer may include a voltage source that applies a voltage to a sample. A laser irradiation unit may irradiate the sample with a laser beam. A detection unit (or a detector) may detect a particle emitted from the sample. An operation unit (or operation device) may specify a material of the particle detected by the detection unit, by mass spectrometry of the particle and analyze the structure of the sample. The operation unit may calculate a ratio in structure between model information indicating the structure of the sample, which is prepared in advance, and analysis information indicating the structure of the sample, which is prepared or obtained by the mass spectrometry, and apply the ratio to the analysis information so as to correct the analysis information.

Hereinafter, embodiments of the disclosure will be described with reference to the drawings. The embodiments are not limited to the disclosure. The drawings are schematic or conceptual, and the ratio and the like between the components are not necessarily the same as those in practice. In the specification and the drawings, components similar to those described above with reference to the drawings are denoted by the same reference signs, and detailed descriptions thereof will be appropriately omitted.

First Embodiment

Figure 1:
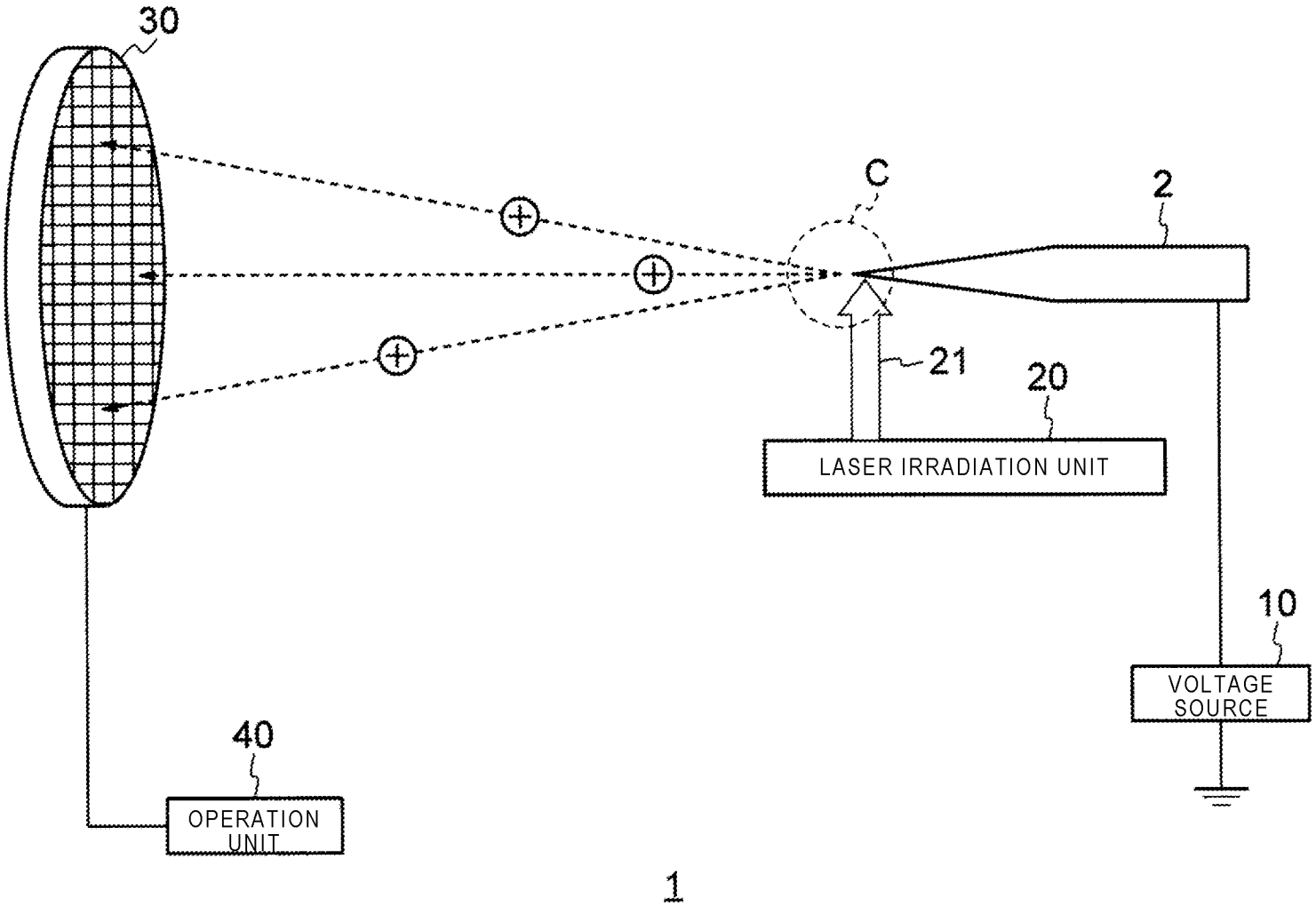
FIG. 1 is a conceptual diagram illustrating a configuration example of a laser atomic probe device according to a first embodiment.

FIG. 1 is a conceptual diagram illustrating a configuration example of a laser atomic probe device 1 according to a first embodiment. The laser atomic probe device (also may be simply referred to as a probe device) 1 includes a voltage source 10, a laser irradiation unit (or a laser irradiator) 20, a detector 30, and an operation unit 40 (or operation device). The components of the probe device 1 may be disposed in a vacuum chamber or on the outside of the vacuum chamber.

The voltage source 10 may apply a high voltage to a sample 2. For example, the voltage source 10 applies a high voltage of 1 kV to 10 kV so as to generate a high electric field between the sample 2 and the detector 30. For example, the sample 2 is a semiconductor material which is cut out from a semiconductor substrate, a semiconductor chip, or the like, and is sharpened to have a needle shape. The tip portion of the sample 2 may be formed to be hemispherical.

The probe device 1 may perform mass spectrometry of ions scattering from the tip portion of the sample 2 to the detector 30 in the high electric field by field evaporation. Thus, the probe device 1 can specify an element or an ion type of the tip portion of the sample 2 and analyze the material or the structure of the tip portion of the sample 2.

The laser irradiation unit 20 may induce field evaporation of atoms from the surface of the tip portion of the sample 2 by irradiating the tip portion of the sample 2 with a laser beam 21. For example, the laser beam 21 is an ultraviolet laser beam and is a pulsed laser which is generated periodically.

The detector 30 may detect ions field-evaporated from the sample 2. For example, the detector 30 may be a position sensitive detector having a two-dimensional detection surface. The detector 30 can recognize the position of the tip portion of the sample 2, from which the ion scatters, by detecting the ion on the detection surface. That is, the detector 30 can detect two-dimensional position information of an atom on the surface of the tip portion of the sample 2.

The operation unit 40 may specify the material of a particle detected by the detector 30, by mass spectrometry of the particle, and analyze the structure of the sample. The operation unit 40 may obtain the two-dimensional position information of an atom detected for each pulse of the laser beam 21, from the detector 30, and reconstruct the structure of the tip portion of the sample 2 in three dimensions. Thus, the operation unit 40 can reconstruct both the three-dimensional structure of the tip portion of the sample 2 and an element constituting the structure, at resolution of an atomic level on data. In some embodiments, the operation unit or operation device 40 may include a processor and memory configured to specify the material of a particle detected by the detector 30, analyze the structure of the sample, obtain the two-dimensional position information, or reconstruct the structure of the tip portion of the sample 2.

Figure 2:
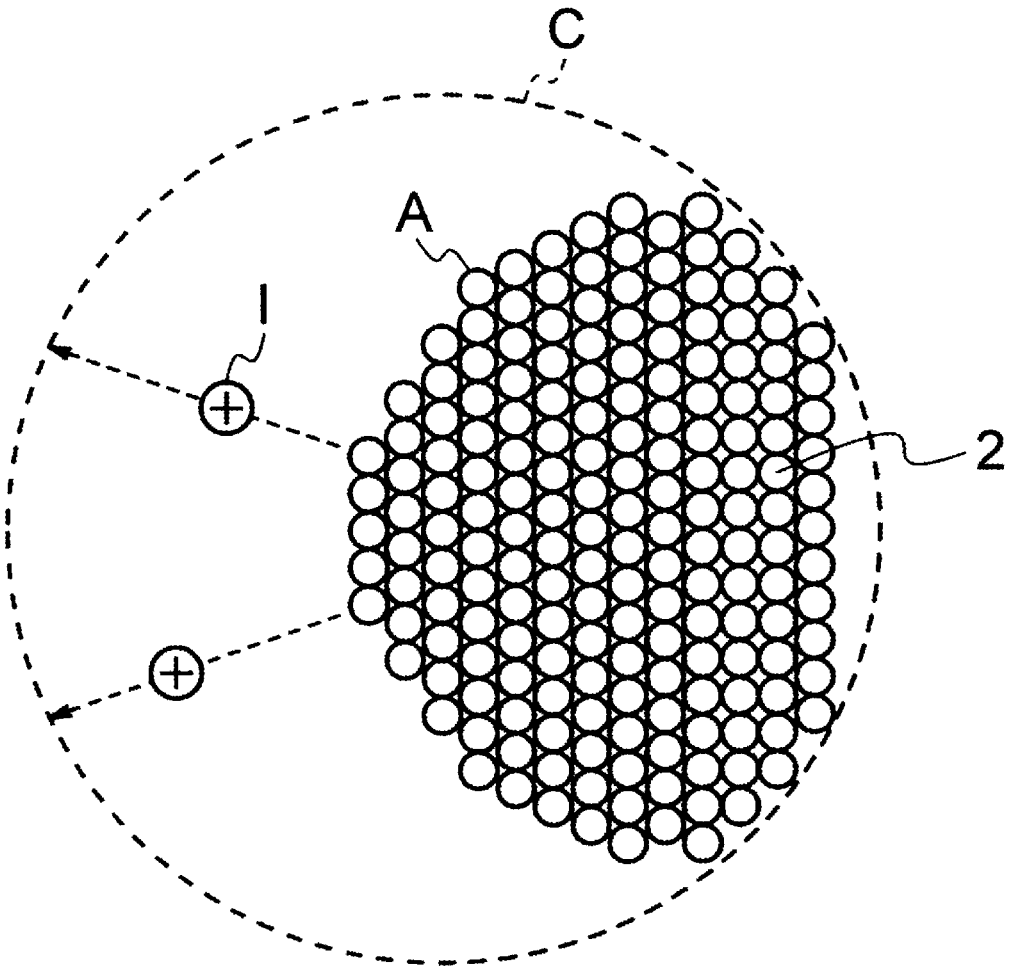
FIG. 2 is a schematic diagram illustrating a state of a tip portion of a sample in a circle indicated by a broken line in FIG. 1.

FIG. 2 is a schematic diagram illustrating a state of the tip portion of the sample 2 in a circle C indicated by a broken line in FIG. 1. A high voltage may be applied to the sample 2 by the voltage source 10. If the tip portion of the sample 2 is irradiated with the laser beam 21, an atom A at the tip portion may come to an ion I and may be field-evaporated. At this time, the atom A on the surface of the tip portion may be field-evaporated by approximately one atom for each pulse of the laser beam 21. The ion I may scatter to the detector 30 in FIG. 1 and may be detected on the detection surface of the detector 30. At this time, the ion I may be detected at the position on the detector 30, in accordance with the position of the atom A on the surface of the sample 2. Thus, the atom A constituting the surface of the sample 2 and the two-dimensional position of the atom A on the surface of the sample 2 can be determined. If the two-dimensional positions of atoms A are accumulated for a plurality of pulses of the laser beam 21, the three-dimensional configuration of the tip portion of the sample 2 can be obtained as data.

At this time, basically, the operation unit 40 may generate the three-dimensional configuration of the tip portion of the sample 2 as data, on the premise that the tip portion of the sample 2 is hemispherical, as illustrated in FIG. 2. However, as described above, in a case where the tip portion of the sample 2 includes a plurality of materials or an irradiation direction of the sample 2 with the laser beam 21 is deviated, the shape of the tip portion of the sample 2 may become a dented shape or a distorted shape from a hemispherical shape. In such a case, in three-dimensional reconstruction processing using measurement data, if three-dimensional reconstruction is performed on the premise that the tip of a sample is hemispherical, it may not be possible for the laser atomic probe device to reconstruct the structure of the sample 2 with accuracy.

The probe device 1 according to the first embodiment may correct analysis information obtained by the mass spectrometry, by using design data or observation data of the sample 2 as model information. The design data or observation data may be prepared in advance. The design data may be the two-dimensional structure or the three-dimensional structure of a portion of the sample 2 from design data of a semiconductor substrate or a semiconductor chip as a base of the sample 2. The observation data may be an image of the sample 2 which is two-dimensional or three-dimensional and may be an appearance image or a transparent image. The image of the sample 2 may be obtained by capturing using any of a scanning electron microscope (SEM), a transmission electron microscope (TEM), a scanning transmission electron microscope (STEM), a scanning ion microscope (SIM), and a scanning probe microscope (SPM). Referring to such model information, a user can determine an actual surface on which density of the sample 2 changes, and an actual surface on which the material of the sample 2 changes. That is, a schematic structure provided on the surface of the sample 2 or in the sample 2 may be known. For example, the structure of a gate electrode, an impurity diffusion layer, a contact plug, or the like may be known to some extent. However, determining the structure (for example, material or density) of the sample 2 at an atomic level may not be possible with such schematic structures.

Analysis information obtained by mass spectrometry may be data on a two-dimensional or three-dimensional structure of the tip portion of the sample 2, which is generated based on information of ions I detected by the detector 30. Thus, the material or density of the sample 2 can be detected at an atomic level by using the analysis information. However, in a case where the shape of the tip portion of the sample 2 is distorted, the analysis information does not accurately indicate the structure of the sample 2.

The operation unit 40 may compare model information and analysis information and calculate a ratio in structure of the sample 2, in order to correct such analysis information. The ratio is calculated, for example, as follows.

Figure 3A:
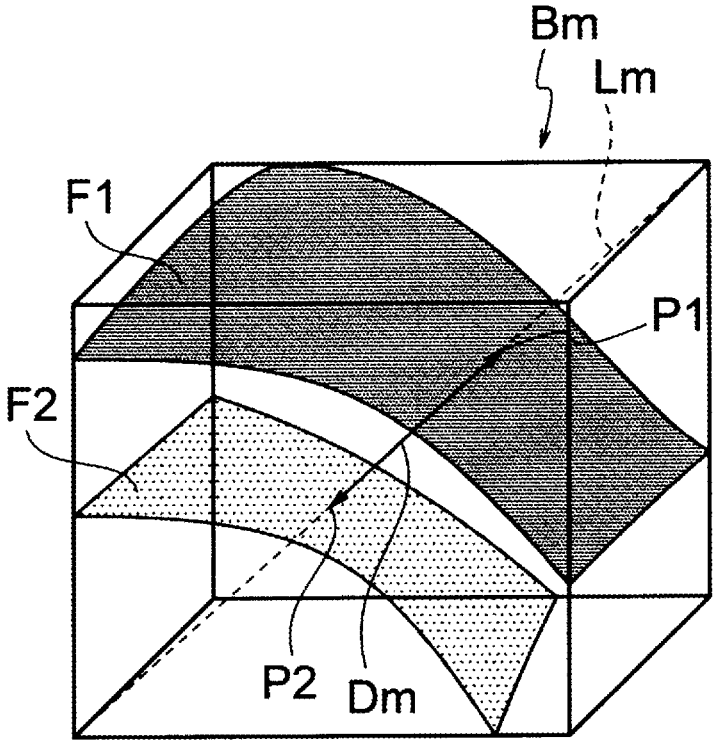
FIG. 3A and FIG. 3B are perspective views illustrating configurations of blocks in model information and analysis information.
Figure 3B:
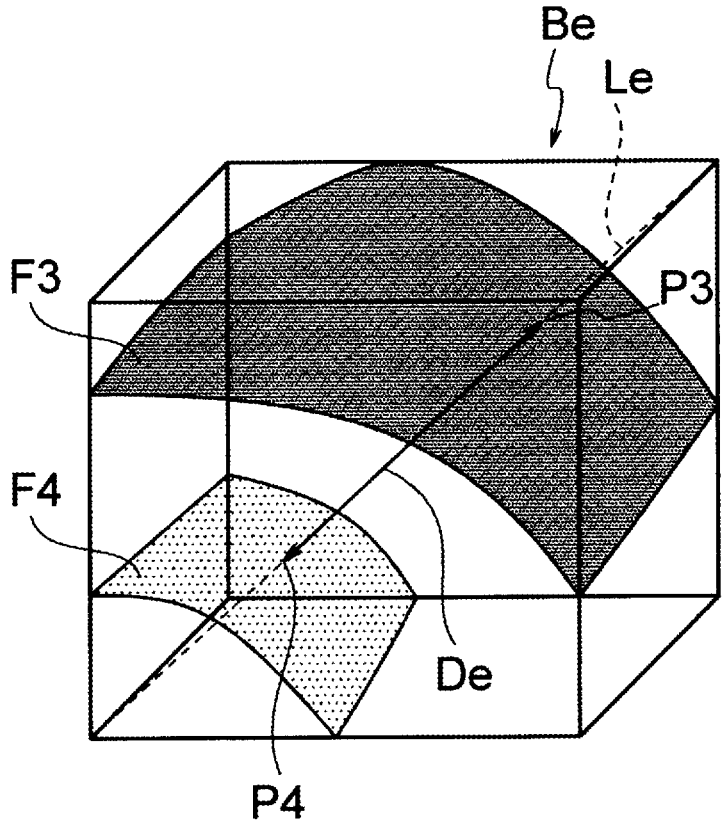

Firstly, the operation unit 40 virtually divides the sample 2 into a plurality of blocks in the model information and the analysis information. FIG. 3A and FIG. 3B are perspective views illustrating configurations of blocks in model information and analysis information. A block Bm of the model information, which is illustrated in FIG. 3A, and a block Be of the analysis information, which is illustrated in FIG. 3B are blocks having the same position and the same shape in the sample 2. For example, the blocks Bm and Be may have a three-dimensional shape such as a cube or rectangular parallelepiped. The length of one side of each of the blocks Bm and Be is about 5 nm, for example. FIG. 3A and FIG. 3B illustrate the three-dimensional structure of the sample 2. In some embodiments, the two-dimensional structure of the sample may be illustrated.

Reference signs F1 to F4 in the blocks Bm and Be indicate equal density surfaces of a certain element. The element may be any of silicon, oxygen, nitrogen, boron, phosphorus, or arsenic, for example. The element may be, for example, metal such as copper, tungsten, or the like.

Referring to FIG. 3A, a first equal density surface F1 and a second equal density surface F2 in the block Bm may indicate different equal density surfaces of the same element. Alternatively, the first equal density surface F1 and the second equal density surface F2 may indicate the equal density surface (or interface) of different elements. Referring to FIG. 3B, a third equal density surface F3 and a fourth equal density surface F4 in the block Be may indicate different equal density surfaces of the same element. Alternatively, the third equal density surface F3 and the fourth equal density surface F4 may indicate the equal density surface (or interface) of different elements.

The first equal density surface F1 in the block Bm and the third equal density surface F3 in the block Be may indicate the same equal density surface of the same element. The second equal density surface F2 in the block Bm and the fourth equal density surface F4 in the block Be may indicate the same equal density surface of the same element. Thus, in a case where the analysis information coincides with the model information, the first equal density surface F1 and the third equal density surface F3 may be displayed as the same surface at the substantially same position in the blocks Bm and Be. The second equal density surface F2 and the fourth equal density surface F4 may be also displayed as the substantially same surface at the substantially same position in the blocks Bm and Be.

However, if the tip portion of the sample 2 comes to a dented shape or a distorted shape from a hemispherical shape, the third and fourth equal density surfaces F3 and F4 in the analysis information may be displayed as different surfaces at different positions in the blocks Bm and Be from the first and second equal density surfaces F1 and F2 in the model information, respectively.

Thus, the operation unit 40 may be calculate a first distance Dm between the first equal density surface F1 and the second equal density surface F2, and calculate a second distance De between the third equal density surface F3 and the fourth equal density surface F4. The operation unit 40 may calculate a ratio (Dm/De) between the first distance Dm and the second distance De and may set the ratio (Dm/De) as a ratio between the model information and the analysis information.

The first distance Dm is a distance between points P1 and P2 which are intersection points of a line segment Lm in a direction in the block Bm with the first and second equal density surfaces F1 and F2. For example, the line segment Lm may be a diagonal line passing through the center of the block Bm. Similarly, the second distance De is a distance between points P3 and P4 which are intersection points of a line segment Le in a direction in the block Be with the third and fourth equal density surfaces F3 and F4. The line segment Le corresponds to the line segment Lm. For example, the line segment Le may be a line segment in the same direction as that of the line segment Lm and may be a diagonal line passing through the center of the block Be. The line segments Lm and Le are line segments corresponding to the blocks Bm and Be, respectively.

The line segments Lm and Le may be another diagonal lines or be a center line passing through the center between any facing surfaces, in the blocks Bm and Be. The operation unit 40 may select a line segment Lm which is approximately vertical to the first equal density surface F1 or the second equal density surface F2 from the block Bm of the model information, which is obtained in advance. The operation unit may set a line segment in the block Be, which corresponds to the selected line segment Lm, as Le.

The operation unit 40 may use the ratio (Dm/De) for correcting the analysis information. For example, the operation unit 40 may correct the position of data in the block Be by multiplying the entirety of data in the block Be of the analysis information by the ratio (Dm/De). The reference point for the correction may be any vertex of the block Bm or may be the center point of the block Bm. The reference point may be a point (for example, any of P1 to P4) in the equal density surface. For example, in a case where the ratio (Dm/De) is 0.95 and the center point of the block Be is set as the reference, the operation unit 40 multiplies the distance from the center point of the block Be to the position of each piece of data in the block Be by 0.95. Thus, the configuration of the block Be in the analysis information can approach the configuration of the block Bm in the model information.

The operation unit 40 may calculate the ratio (Dm/De) for other blocks (not illustrated) of the sample 2 and correct the position of data for each block of the analysis information by using the calculated ratio (Dm/De), in the similar manner. That is, the operation unit 40 may calculate the ratio (Dm/De) for each block of the sample 2 and correct data for each block. As a result, the analysis information can indicate a structure similar to the actual shape of the sample 2. That is, even when the shape of the tip portion of the sample 2 is distorted, the operation unit 40 can correct the analysis information by using the model information, so as to have a configuration similar to the actual shape of the sample 2. Thus, the probe device 1 can accurately analyze the structure of the sample 2 by mass spectrometry even when the tip portion of the sample 2 deforms.

In the embodiment, F1 to F4 in FIG. 3A and FIG. 3B indicate the equal density surfaces. However, F1 to F4 in FIG. 3A and FIG. 3B may be change surfaces of an element or an ion type, that is, may be interfaces between different materials. In this case, the operation unit 40 may calculate the first distance Dm between the first change surface F1 and the second change surface F2 on which the element or the ion type changes, in the block Bm of the model information. The operation unit 40 may calculate the second distance De between the third change surface F3 and the fourth change surface F4 on which the element or the ion type changes, in the block Be of the analysis information. That is, the first and second distances Dm and De may be set as distances between the interfaces. The operation unit 40 may calculate the ratio (Dm/De) between the first distance Dm and the second distance De and multiply coordinates of data in the block Be by the calculated ratio so as to correct the position of the data in the block Be. As described above, the operation unit 40 may correct the analysis information by using the surface on which the material changes.

Next, a sample analysis method using the probe device 1 according to the first embodiment will be described.

Figure 4:
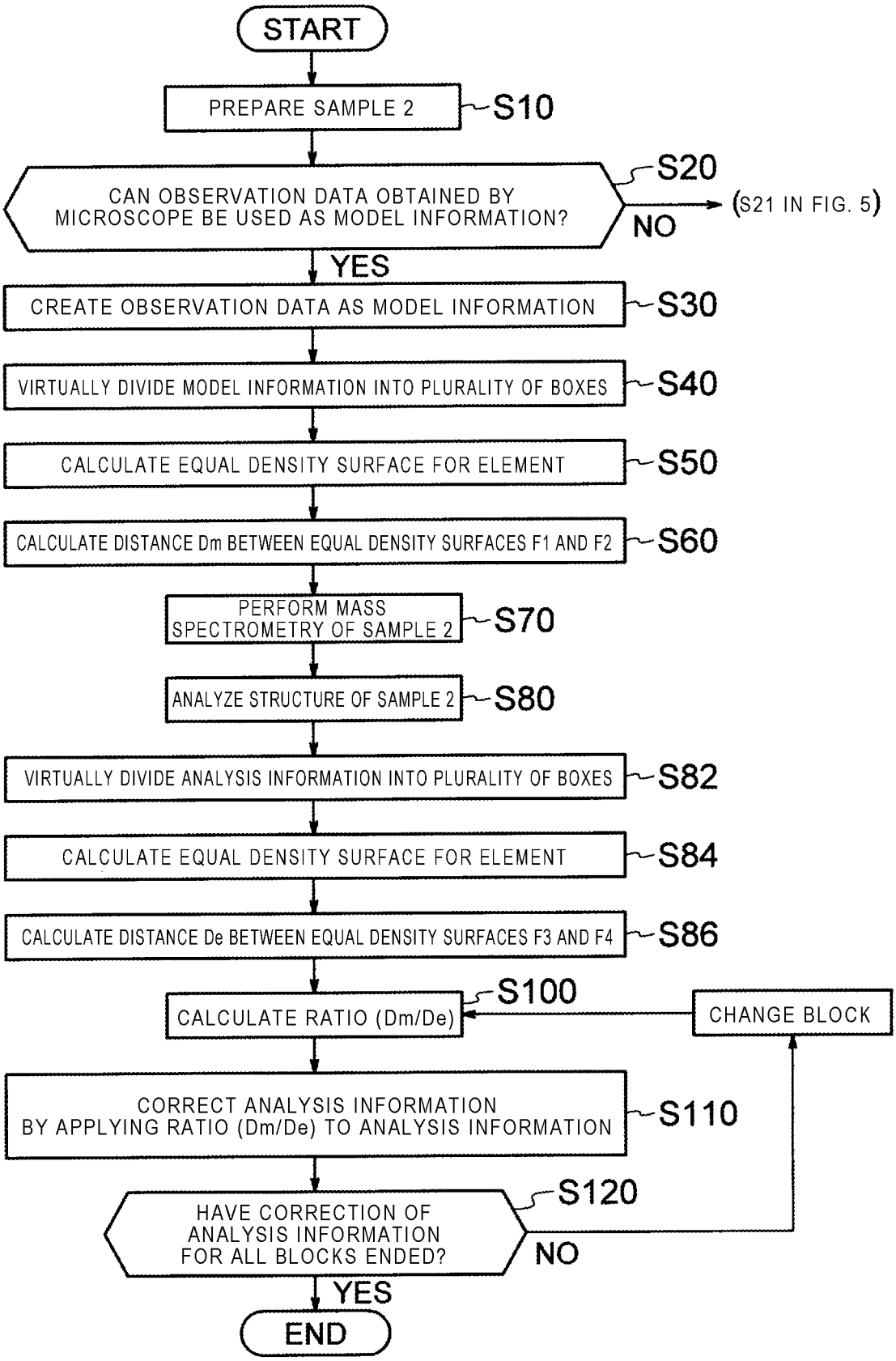
FIG. 4 is a flowchart illustrating an example of a sample analysis method according to the first embodiment.

FIG. 4 is a flowchart illustrating an example of the sample analysis method according to the first embodiment.

Firstly, a sample 2 may be prepared from a semiconductor substrate by using a focused ion beam (FIB) method, an electrolytic polishing method, or the like (S10). The tip portion of the sample 2 may be sharpened to have a needle shape.

Then, it may be determined whether or not observation data obtained by a microscope such as a SEM, a TEM, a STEM, and an SPM can be used as model information of the sample 2 (S20). For example, in a case where density or the material changes to be small in the sample 2, or the structure of the sample 2 is too complicated, using the observation data itself obtained by the microscope as the model information has difficulty (NO in S20). In such a case, simulation data other than the observation data may be used as the model information. The sample analysis method using the simulation data will be described later with reference to FIG. 5.

In a case where the observation data obtained by the microscope can be used as the model information of the sample 2 (YES n S20), the observation data in the microscope may be created as the model information (S30). At this time, the model information may be created as a model of a three-dimensional structure of the sample 2.

Then, the model information may be virtually divided into a plurality of boxes (on data) (S40). The box is, for example, a cube having a side of about 1 nm. The operation unit 40 may calculate the composition in each box and calculates a three-dimensional equal density surface for a certain element from the composition (S50).

Then, the operation unit may calculate a distance Dm between a plurality of equal density surfaces F1 and F2 in a state where the plurality of boxes is set as one block Bm (S60). For example, the operation unit 40 may set 5×5×5 pieces of boxes (total 125 boxes) as one block Bm and calculate the distance Dm between the equal density surfaces F1 and F2, as described with reference to FIG. 3A and FIG. 3B.

Then, the operation unit may perform mass spectrometry of the sample 2 using the probe device 1 (S70). The operation unit 40 may specify an element detected by the detector 30, by the mass spectrometry of the element, and analyze the structure of the sample 2 based on position information detected by the detector 30 (S80). Thus, the operation unit 40 can reconstruct both the structure of the tip portion of the sample 2 and the element constituting the sample 2 in three dimension on data. Data of the sample 2, which is reconstructed by the mass spectrometry in this manner may be referred to as analysis information (or atom map).

Then, processing similar to processing of Steps S40 to S60 may be also performed on the analysis information. That is, the analysis information may be virtually divided into a plurality of boxes (on data) (S82). The operation unit 40 may calculate the composition in each box and calculate a three-dimensional equal density surface for a certain element from the composition (S84). The operation unit may calculate a distance De between a plurality of equal density surfaces F3 and F4 in a state where the plurality of boxes is set as one block Be (S86).

Then, the operation unit 40 may calculate a ratio (Dm/De) from the distance Dm and the distance De (S100).

The operation unit 40 may correct the analysis information by applying the ratio (Dm/De) to the analysis information (atom map) (S110). For example, the operation unit 40 may obtain the corrected analysis information by multiplying the analysis information by the ratio (Dm/De).

Steps S100 and S110 may be also performed on other blocks of the tip portion of the sample 2 (NO in S120). In a case where correction of the analysis information for all blocks has ended (YES in S120), correction of the analysis information may end. As described above, the operation unit 40 can obtain ratio variation distribution for the entirety of the tip portion of the sample 2 and can correct the analysis information by using the ratio variation distribution. A user can analyze the structure of the sample 2 with reference to the corrected analysis information, for example, the atom map.

As described above, according to the first embodiment, the operation unit 40 may calculate the ratio (Dm/De) in structure of the sample 2 and correct data of the analysis information by using the calculated ratio (Dm/De). Thus, the analysis information can indicate a structure similar to the actual shape of the sample 2. That is, even when the shape of the tip portion of the sample 2 is distorted, the operation unit 40 can correct the analysis information by using the model information, so as to have a configuration similar to the actual shape of the sample 2. As a result, the user can accurately analyze the structure of the sample 2.

According to the first embodiment, the operation unit 40 can calculate the ratio (Dm/De) of the sample 2 for each block, and locally correct data of the analysis information for each block by using the ratio (Dm/De). Thus, even when the sample 2 is locally distorted, the operation unit 40 can correct the analysis information so as to approach the actual shape of the sample 2. The size of the block may be reduced, and the resolution may increase, in order to accurately correct the analysis information.

In the first embodiment, the observation data may be used as the model information. However, in a case where design data can be obtained, the design data can be used as the model information. In this case, the operation unit may divide the design data into a plurality of boxes and calculate an equal density surface for each of the boxes. The operation unit may calculate the distance Dm from the equal density surface. As described above, it is possible to correct the analysis information even by using the design data. The analysis information may be created and corrected in a personal computer or the like which is separate from the probe device 1.

Second Embodiment

Figure 5:
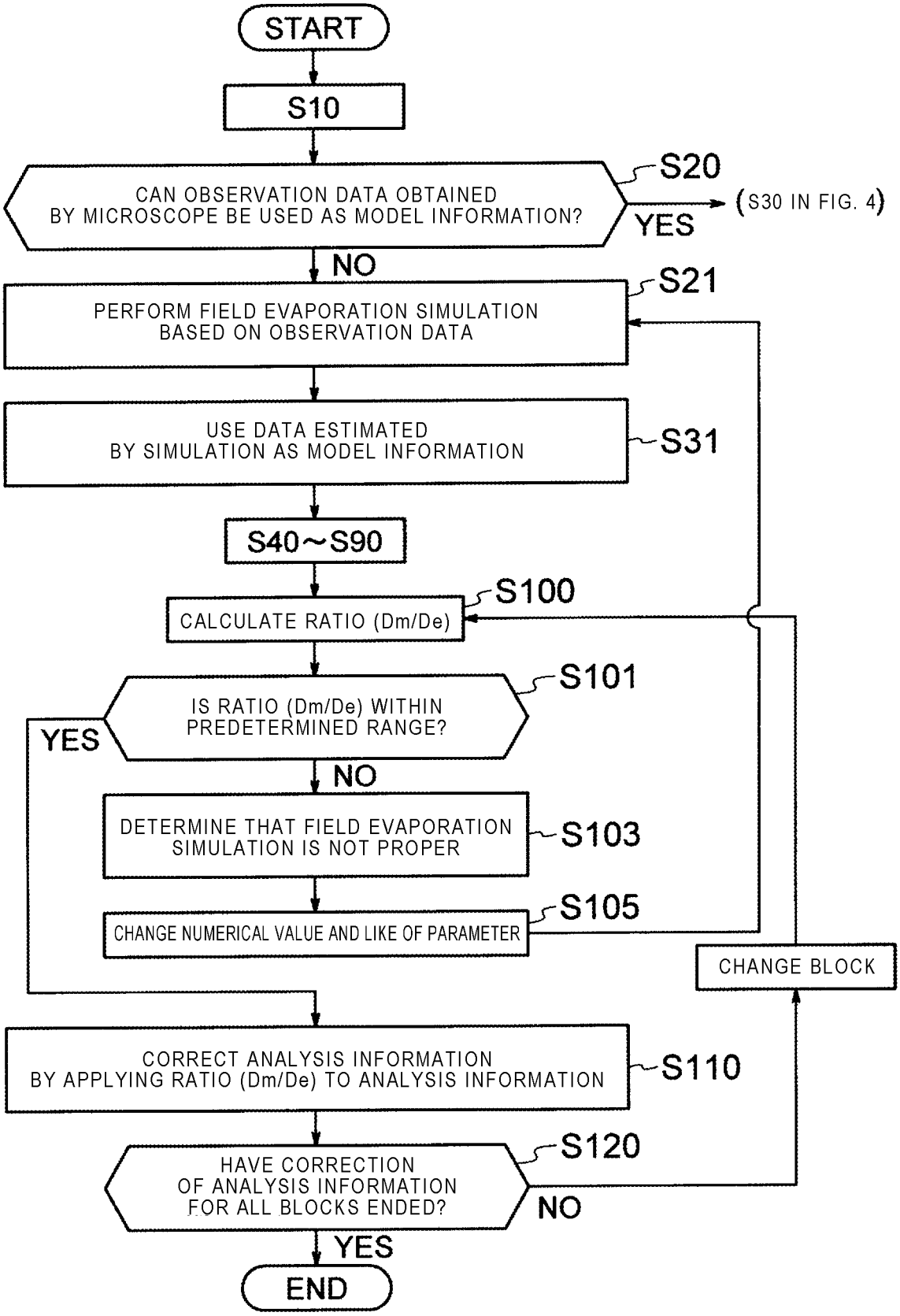
FIG. 5 is a flowchart illustrating an example of a sample analysis method of a probe device according to a second embodiment.

FIG. 5 is a flowchart illustrating an example of a sample analysis method of a probe device 1 according to a second embodiment. The second embodiment represents a sample analysis method in a case where using the observation data as the model information is not possible in Step S20. The configuration of the probe device 1 according to the second embodiment may be similar to that in the first embodiment.

For example, in a case where density or the material changes to be small in the sample 2, or the structure of the sample 2 is complicated, using the observation data itself obtained by the microscope as the model information may be difficult (NO in S20). In a case where obtaining the design data is not possible, creating model information from the design data also may be difficult. In such a case, in the second embodiment, observation data may be obtained by using any of the above-described microscopes, and a field evaporation simulation is performed based on the observation data (S21). Data estimated by the simulation may be used as the model information (S31).

The field evaporation simulation may include a simulation in the process of field evaporation and a simulation of calculating a scattering trajectory of an ion after the field evaporation. Thus, the ion type (e.g., chemical element) detected by the detector 30, the detection position of the ion, and detection procedures of the ion may be simulated based on data. As the field evaporation simulation, for example, a method disclosed in "C. Oberdorfer et al., Ultramicroscopy 128 (2013) 55-67" can be used.

Then, the operation unit may perform Steps S40 to S100 in the first embodiment.

Then, the operation unit 40 may determine whether or not the ratio (Dm/De) of each block, which is calculated in Step S100 is within a predetermined range (S101). The predetermined range is shown by Expression 1, for example.

$$0.9<Dm/De<1.1 \quad \text{(Expression 1)}$$

In a case where the ratio (Dm/De) for a certain block is not within the range by Expression 1 (NO in S101), the operation unit 40 may determine that the field evaporation simulation is not proper (S103), and perform the field evaporation simulation in S21 again. At this time, the operation unit may change the numerical value and the like of a parameter input for the field evaporation simulation (S105). For example, as the parameter, at least one of the film thickness, the width, the height of a device structure in the sample 2, the evaporation electric field of a material, or the like are provided.

In a case where the ratios (Dm/De) for all blocks are within the range by Expression 1 (YES in S101), the operation unit 40 may perform Step S110 and correct analysis information (atom map), similar to the first embodiment.

The subsequent operations may be similar to those in the first embodiment.

According to the second embodiment, even when using the observation data itself as the model information is not possible, three-dimensional structure data can be created by performing the field evaporation simulation with respect to the observation data. The operation unit 40 can calculate the ratio (Dm/De) and correct the analysis information, by using such three-dimensional structure data as the model information. Thus, in the second embodiment, it is possible to obtain effects similar to those in the first embodiment.

As the sample 2, a sample which is capable of being analyzed may be provided. The entirety of the sample may have a needle-like shape or a protrusion shape formed on a flat surface such as a substrate. The probe device 1 may use a voltage pulse instead of the pulsed laser beam or along with the pulsed laser beam. The probe device 1 may be mounted in any of the SEM, the TEM, the STEM, and the SPM.

Third Embodiment

As described above, in a case where the tip portion of the sample 2 includes a plurality of materials or the irradiation direction of the sample 2 with the laser beam 21 is deviated, the shape of the tip portion of the sample 2 may become a dented shape or a distorted shape from a hemispherical shape by the field evaporation.

Figure 6A:
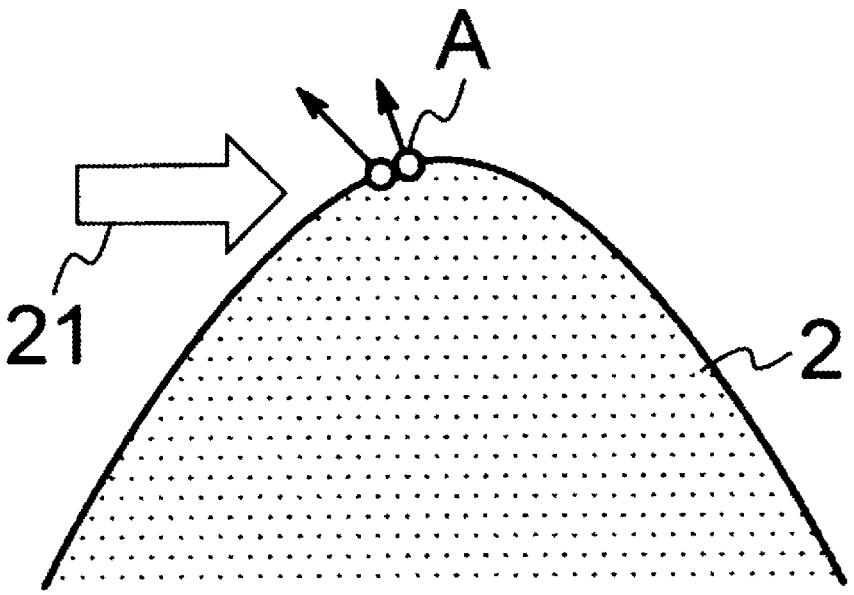
FIG. 6A and FIG. 6B are conceptual diagrams illustrating a case where a sample is irradiated with a laser beam in one direction.
Figure 6B:
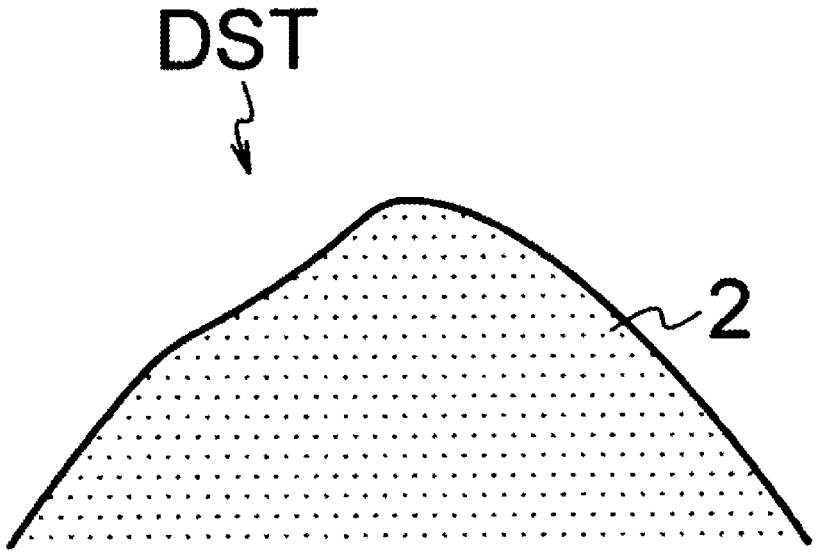

For example, FIG. 6A and FIG. 6B are conceptual diagrams illustrating a case where the sample 2 is irradiated with the laser beam 21 in one direction. As illustrated in FIG. 6A, if the sample is irradiated with the laser beam 21 from one direction, field evaporation of an atom may occur from an irradiation portion. Thus, as illustrated in FIG. 6B, a dent or distortion DST may occur at the tip portion of the sample 2.

Figure 8:
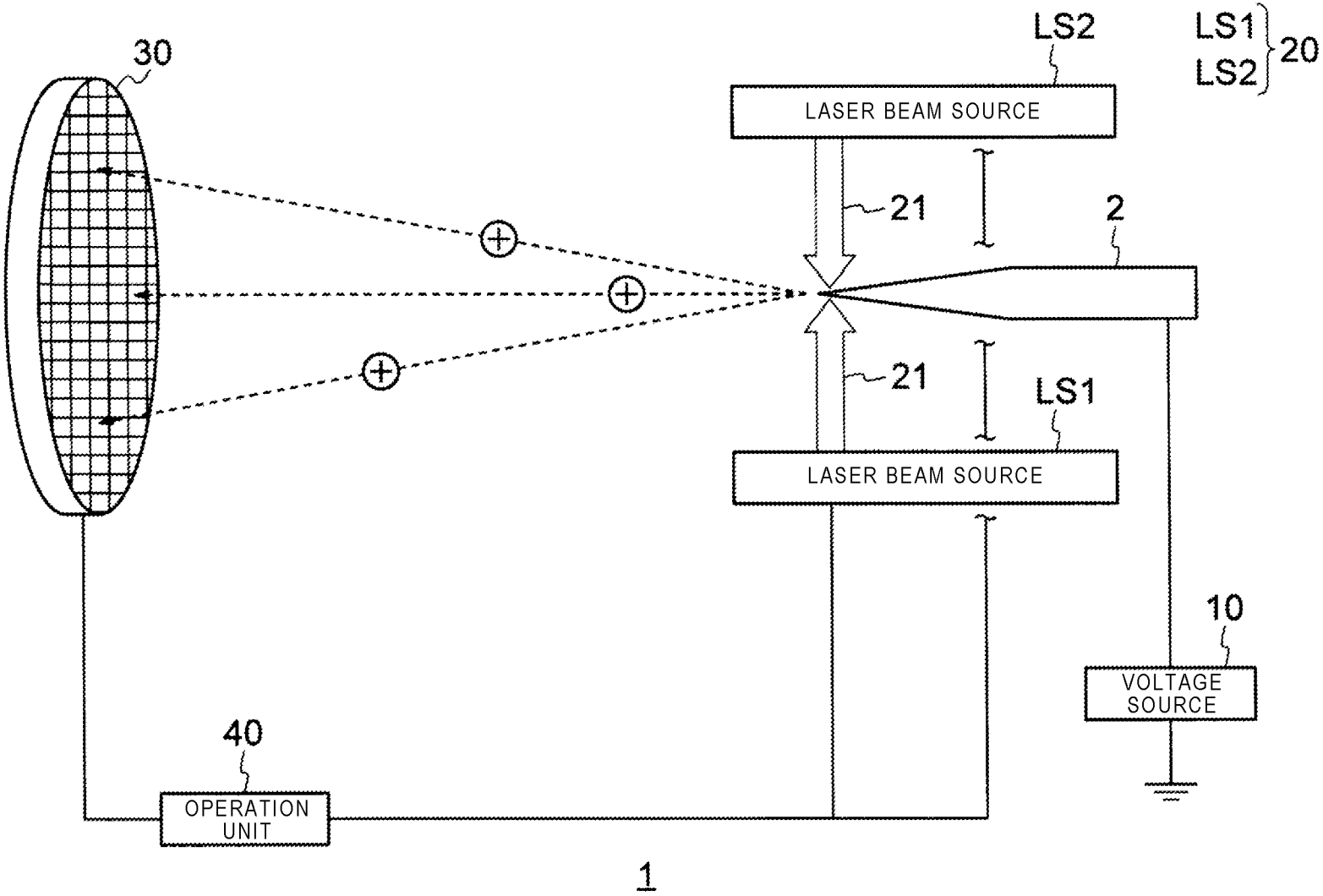
FIG. 8 is a conceptual diagram illustrating a configuration example of a probe device according to a third embodiment.

As illustrated in FIG. 8, a laser irradiation unit 20 according to a third embodiment may include a plurality of laser beam sources LS1 and LS2. FIG. 8 is a conceptual diagram illustrating a configuration example of a probe device 1 according to the third embodiment. The plurality of laser beam sources LS1 and LS2 may irradiate the sample 2 with laser beams 21 from substantially symmetric directions. The number of laser beam sources may be equal to or greater than 3. The laser beam sources may be preferably arranged around the tip of the sample 2 substantially symmetrically and uniformly. Thus, the tip portion of the sample 2 can be uniformly irradiated with the laser beam 21 and thus the laser beam 21 can cause atoms to be uniformly field-evaporated from the surface of the tip portion of the sample 2.

Figure 7A:
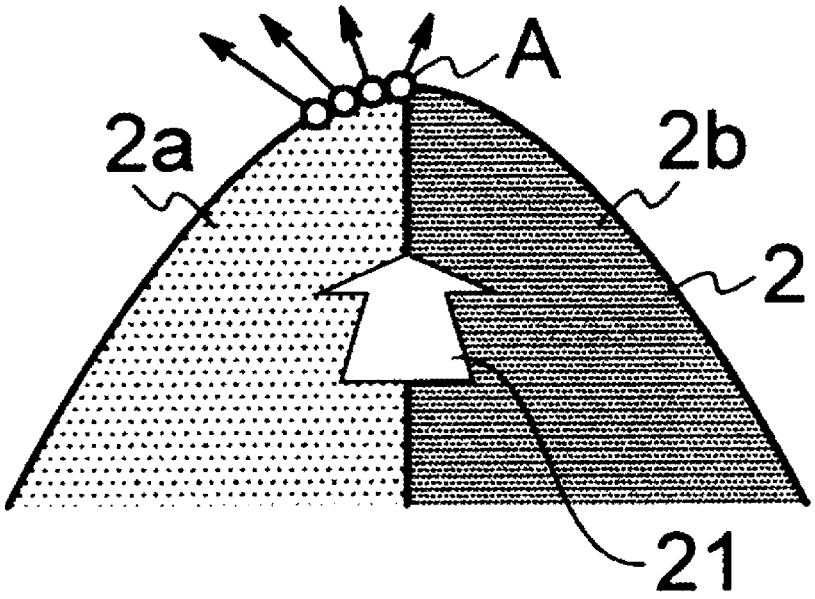
FIG. 7A and FIG. 7B are conceptual diagrams illustrating a case where a tip portion of the sample includes a plurality of materials.
Figure 7B:
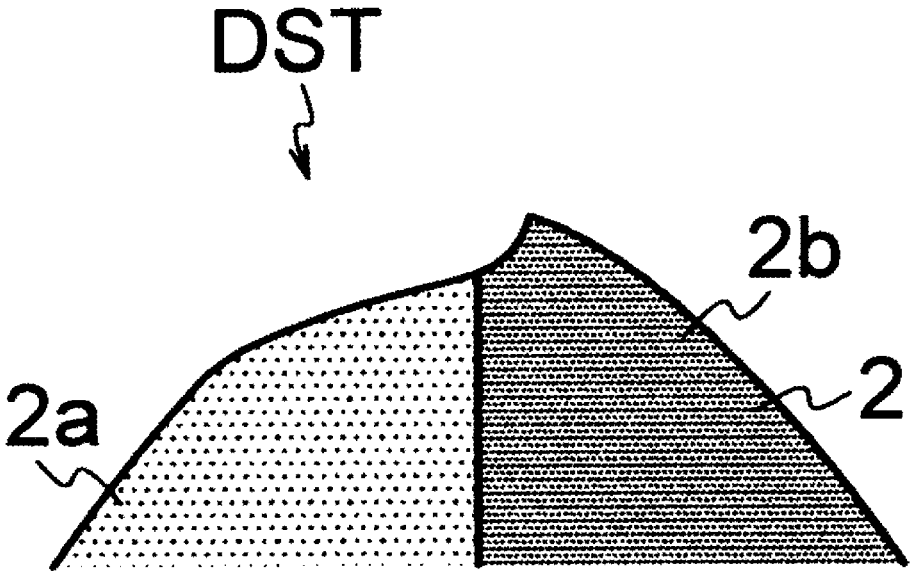

In a case where the tip portion of the sample 2 includes a plurality of materials having different evaporation fields, even when the tip portion of the sample 2 is substantially uniformly irradiated with the laser beam 21, a dent or distortion DST may occur at the tip portion of the sample 2 due to the difference of the evaporation field. For example, FIG. 7A and FIG. 7B are conceptual diagrams illustrating a case where the tip portion of the sample 2 includes a plurality of materials. As illustrated in FIG. 7A, in a case where the tip portion of the sample 2 includes a plurality of materials 2*a* and 2*b* having different evaporation fields, the number of atoms subjected to field evaporation in the material 2*a* having a smaller evaporation field is more than the number of atoms subjected to field evaporation in the material 2*b* having a larger evaporation field. Thus, as illustrated in FIG. 7B, a dent or distortion DST may occur at the tip portion of the sample 2.

The operation unit 40 according to the third embodiment may change an output of each of the plurality of laser beam sources LS1 and LS2 based on the number of ions detected by the detector 30 or density of the ions.

Figure 9A:
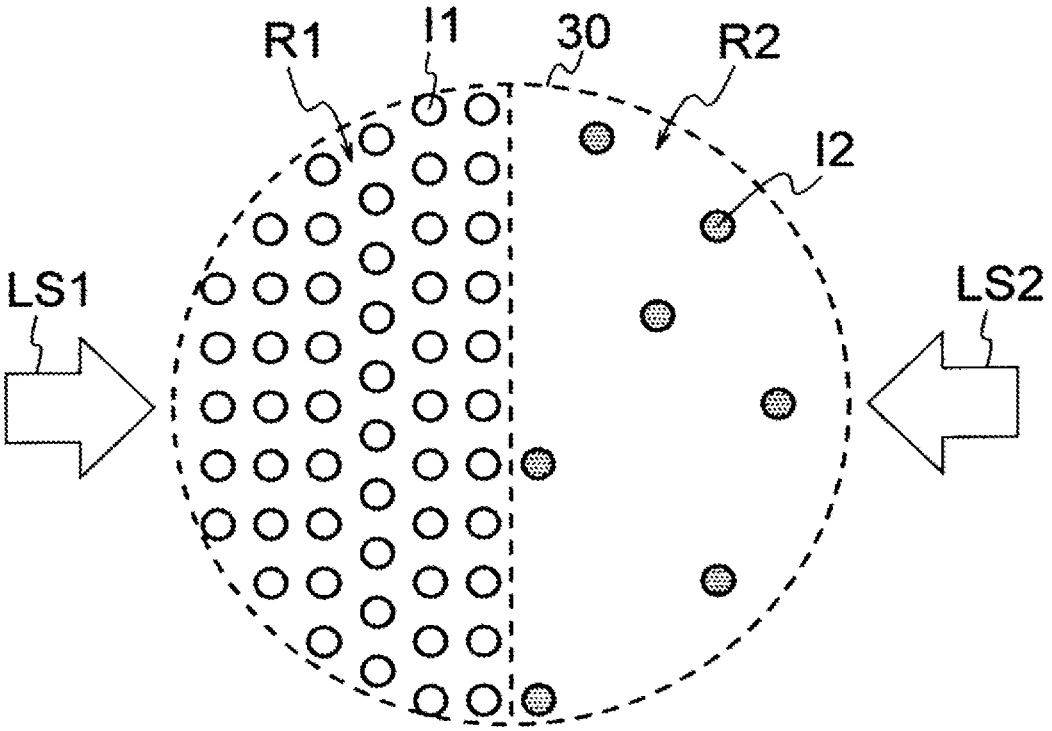
FIG. 9A and FIG. 9B are conceptual diagrams illustrating a detection surface of a detector and ions detected on the detection surface.
Figure 9B:
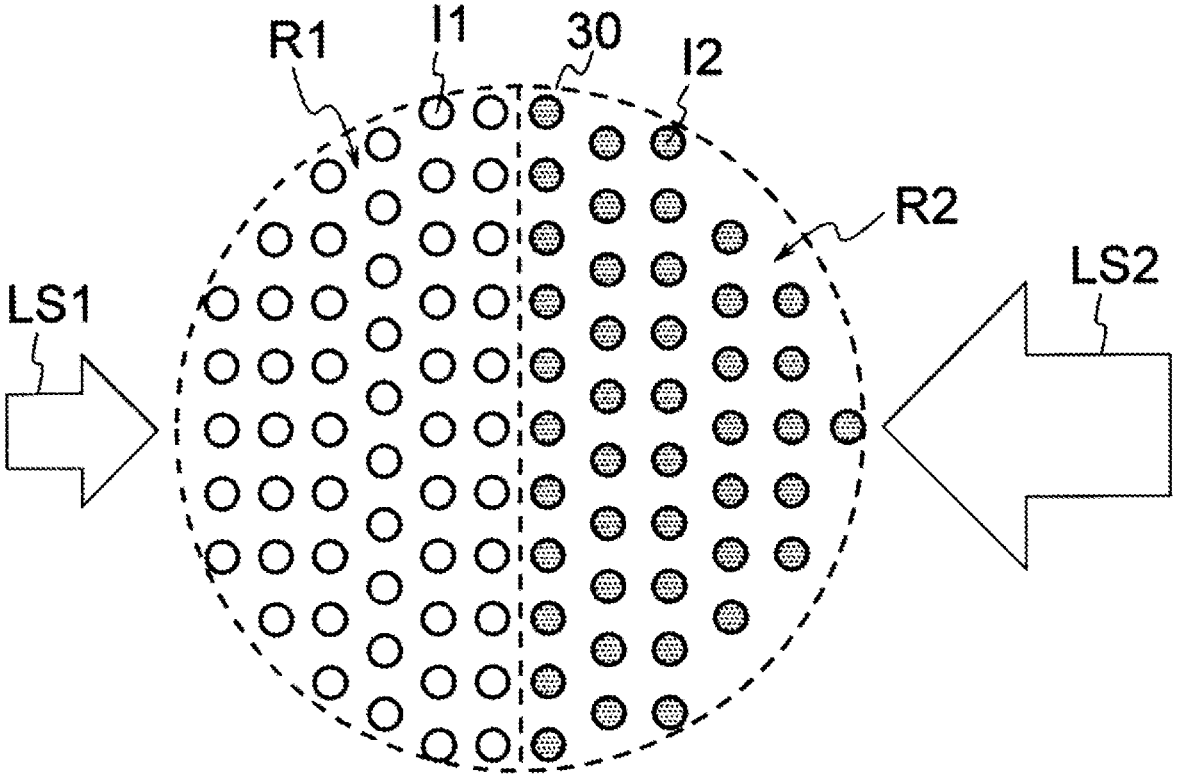

For example, FIG. 9A and FIG. 9B are conceptual diagrams illustrating the detection surface of the detector 30 and ions I1 and I2 detected on the detection surface. The ion I1 is an ion from the material 2*a* in FIG. 7A and FIG. 7B. The ion I2 is an ion from the material 2*b* in FIG. 7A and FIG. 7B. In FIG. 9A, outputs of the laser beam sources LS1 and LS2 may be substantially equal to each other, and the tip portion of the sample 2 may be uniformly irradiated with the laser beam 21. However, the ion I1 may be field-evaporated more than the ion I2 because of the difference of the material at the tip portion of the sample 2. In this case, the number of ions I2 detected by the detector 30 may be smaller than the number of ions I1. This may result in the occurrence of a dent or distortion DST in FIG. 7B.

On the contrary, the operation unit 40 in the third embodiment may perform feedback control of the outputs of the laser beam sources LS1 and LS2 based on the ion types (I1 and I2) detected by the detector 30 and in-surface distribution of the number of detected ions of each of the ion types. For example, as illustrated in FIG. 9A, the detection surface of the detector 30 may be virtually divided into first and second detection regions R1 and R2 so as to correspond to the laser beam sources LS1 and LS2, respectively. The first detection region R1 may be a half detection surface on the laser beam source LS1 side. The second detection region R2 may be a half detection surface on the laser beam source LS2 side. The sample 2 may be disposed such that the ions I1 are detected in the first detection region R1 and the ions I2 are detected in the second detection region R2.

In a case where the number of detected ions I2 or detection density thereof in the second detection region R2 of the detector 30 is smaller than the number of detected ions I1 or detection density thereof in the first detection region R1, the operation unit 40 may control the output of the laser beam source LS2 to increase and thus increases the light intensity of the laser beam 21 from the laser beam source LS2. The operation unit 40 may control the outputs of the laser beam sources LS1 and LS2 in real time while the detector 30 detects the ions I1 and I2. Thus, the number of detected ions I2 or the detection density thereof in the detector 30 may increase. As illustrated in FIG. 9B, the operation unit 40 may control the outputs of the laser beam sources LS1 and LS2 such that the number of detected ions I1 or the detection density thereof is substantially equal to the number of detected ions I2 or the detection density thereof.

As described above, according to the third embodiment, the operation unit 40 may perform feedback control of the outputs of the laser beam sources LS1 and LS2 based on the number of ions I1 and I2 detected by the detector 30 and or density of ions I1 and I2. At this time, the operation unit 40 may virtually divide the detection surface of the detector 30 into a plurality of detection regions R1 and R2 and control the outputs of the laser beam sources LS1 and LS2 such that the number of ions detected in the detection region R1 or density of the detected ions is substantially equal to the number of ions detected in the detection region R2 or density of the detected ions. Thus, it is possible to prevent the occurrence of a dent or distortion DST on the sample 2 including a plurality of materials as illustrated in FIG. 7B.

Figure 10:
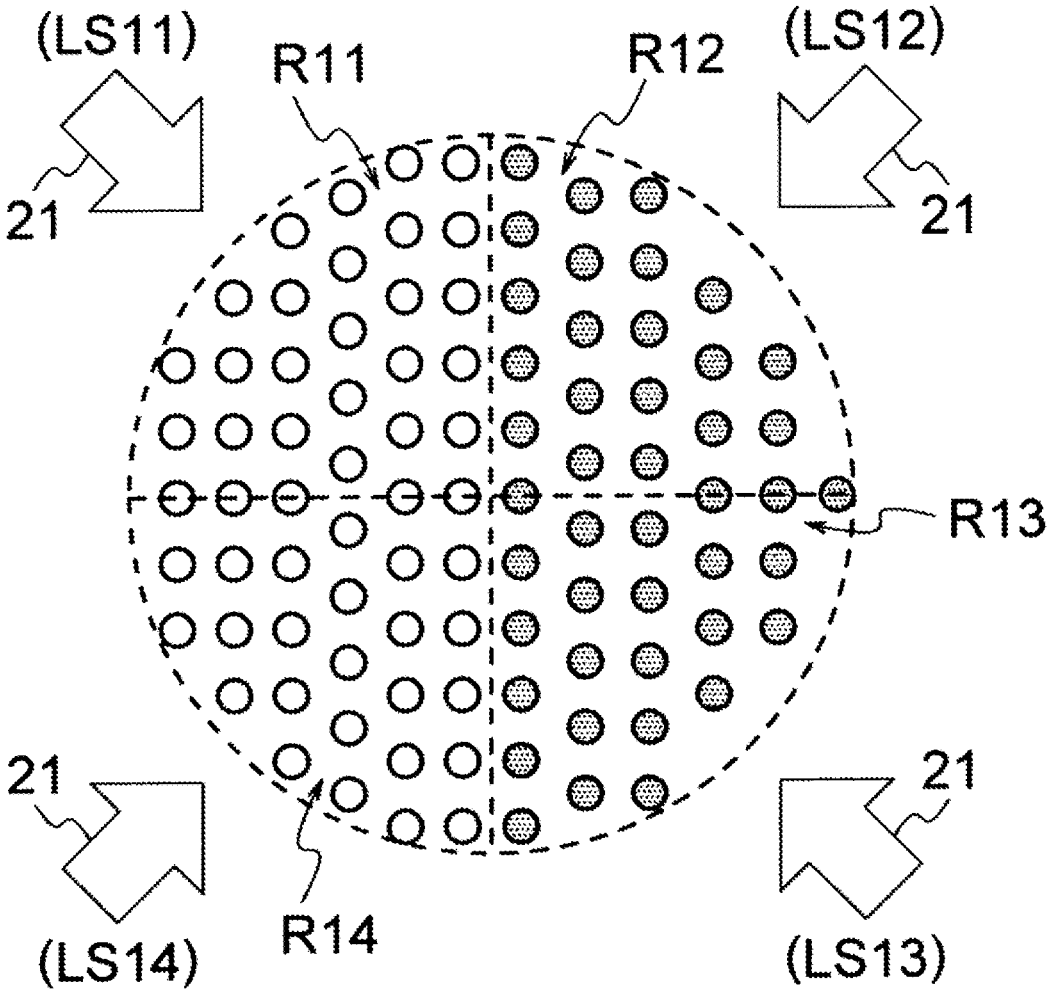
FIG. 10 is a conceptual diagram illustrating the detection surface of the detector, which is divided into four, and ions detected on the detection surfaces.

The number of divisions of the detection surface of the detector 30 may be equal to the number of laser beam sources capable of being independently controlled. For example, FIG. 10 is a conceptual diagram illustrating the detection surface of the detector 30, which is divided into four, and ions I1 and I2 detected on the detection surface. In the example of FIG. 10, the tip portion of the sample 2 is irradiated with the laser beam 21 from four laser beam sources LS11 to LS14. The detection surface of the detector 30 is virtually divided into four, that is, first to fourth regions R11 to R14 so as to correspond to the four laser beam sources LS11 to LS14, respectively. The operation unit 40 performs feedback control of an output of each of the laser beam sources LS11 to LS14 based on the number of ions detected by the first to fourth regions R11 to R14 and density of the detected ions. As described above, the number of laser beam sources and the number of divided regions in the detector 30 may have any values and may not be particularly limited. Thus, it is possible to prevent the occurrence of a dent or distortion DST on the sample 2.

In some embodiments, the number of divisions of the detection surface of the detector 30 may be different from the number of laser beam sources capable of being independently controlled. The number of divisions of the detection surface may also be smaller than the number of laser beam sources in accordance with the structure or the material of the sample 2. In some embodiments, the number of divisions of the detection surface may be greater than the number of laser beam sources in accordance with the structure or the material of the sample 2. As the number of divisions of the detection surface increases, the sample 2 can be analyzed finer.

Next, a sample analysis method according to the third embodiment will be described.

Figure 11:
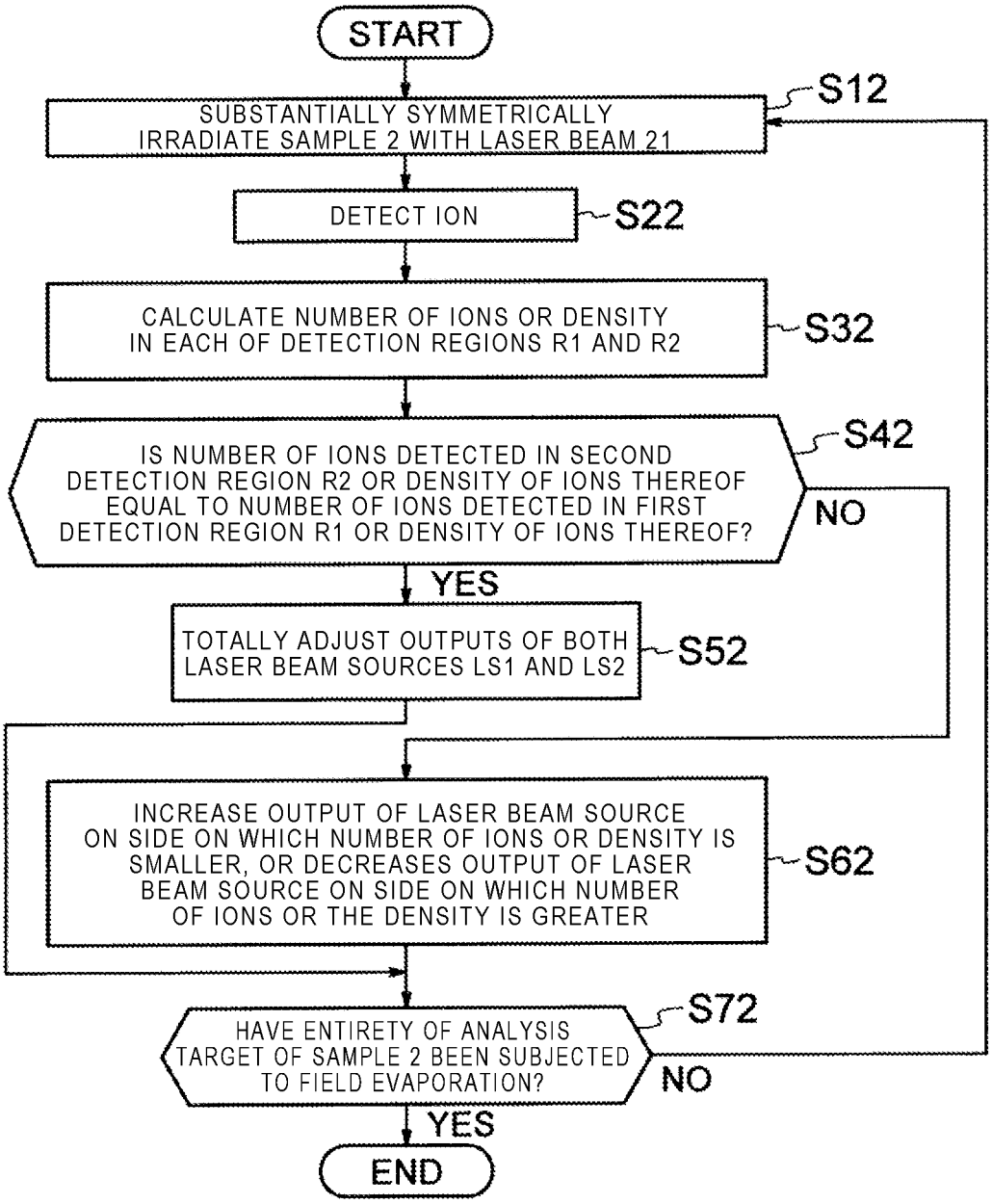
FIG. 11 is a flowchart illustrating an example of a sample analysis method according to a third embodiment.

FIG. 11 is a flowchart illustrating an example of the sample analysis method according to the third embodiment. For example, as illustrated in FIG. 8 to FIG. 9B, the sample 2 is irradiated with the laser beam 21 of two laser beam sources LS1 and LS2 from both sides of the sample 2.

Firstly, the sample 2 may be substantially symmetrically irradiated with laser beam 21 from the laser beam sources LS1 and LS2. The laser beam sources LS1 and LS2 may perform irradiation simultaneously or alternately (S12). Then, the detector 30 may detect ions field-evaporated from the sample 2 (S22). The operation unit 40 may calculate the number of ions, the number of detected atoms, density, and the like in each of the detection regions R1 and R2 (S32). The operation unit 40 may compare the number of ions detected in the second detection region R2, the number of detected atoms, density, or the like to the number of ions detected in the first detection region R1, the number of detected atoms, density, or the like (S42). A timing at which the number of ions, the number of detected atoms, the density, or the like are compared between the detection regions R1 and R2 may be arbitrarily determined. Regarding the comparison timing, for example, the comparison may be performed every time a predetermined period elapses, the number of detected atoms reaches a predetermined value, or the number of times of irradiation with laser reaches a predetermined value.

In a case where the number of ions detected in the second detection region R2 or the density thereof is substantially equal to the number of ions detected in the first detection region R1 or the density thereof (YES in S42), the operation unit 40 may totally adjust both of the outputs of the laser beam sources without changing an output ratio between the laser beam sources LS1 and LS2 (S52).

In a case where the number of ions detected in the second detection region R2 or the density thereof is not equal to the number of ions detected in the first detection region R1 or the density thereof (NO in S42), the operation unit 40 may increase the output of the laser beam source LS1 (or LS2) on the side on which the number of ions or the density is smaller, or decrease the output of the laser beam source LS2 (or LS1) on the side on which the number of ions or the density is greater (S62).

Steps S12 to S62 may repeat until the entirety of an analysis target (tip portion) of the sample 2 is subjected to field evaporation (NO in S72). If the entirety of an analysis target (tip portion) of the sample 2 is subjected to field evaporation (YES in S72), the analysis may end.

As described above, the probe device 1 may perform feedback control of the outputs of the laser beam sources LS1 and LS2 based on the number of ions detected by the detector 30 and or the density of the ions. Thus, the operation unit 40 can adjust the number of detected ions or the density of the ions such that the number of ions detected in the first detection region R1 or the density of the ions is substantially equal to the number of ions detected in the second detection region R2 or the density of the ions. As a result, it is possible to prevent deformation of the tip portion of the sample 2 from the substantially hemispherical shape.

MODIFICATION EXAMPLE 1

Figure 12:
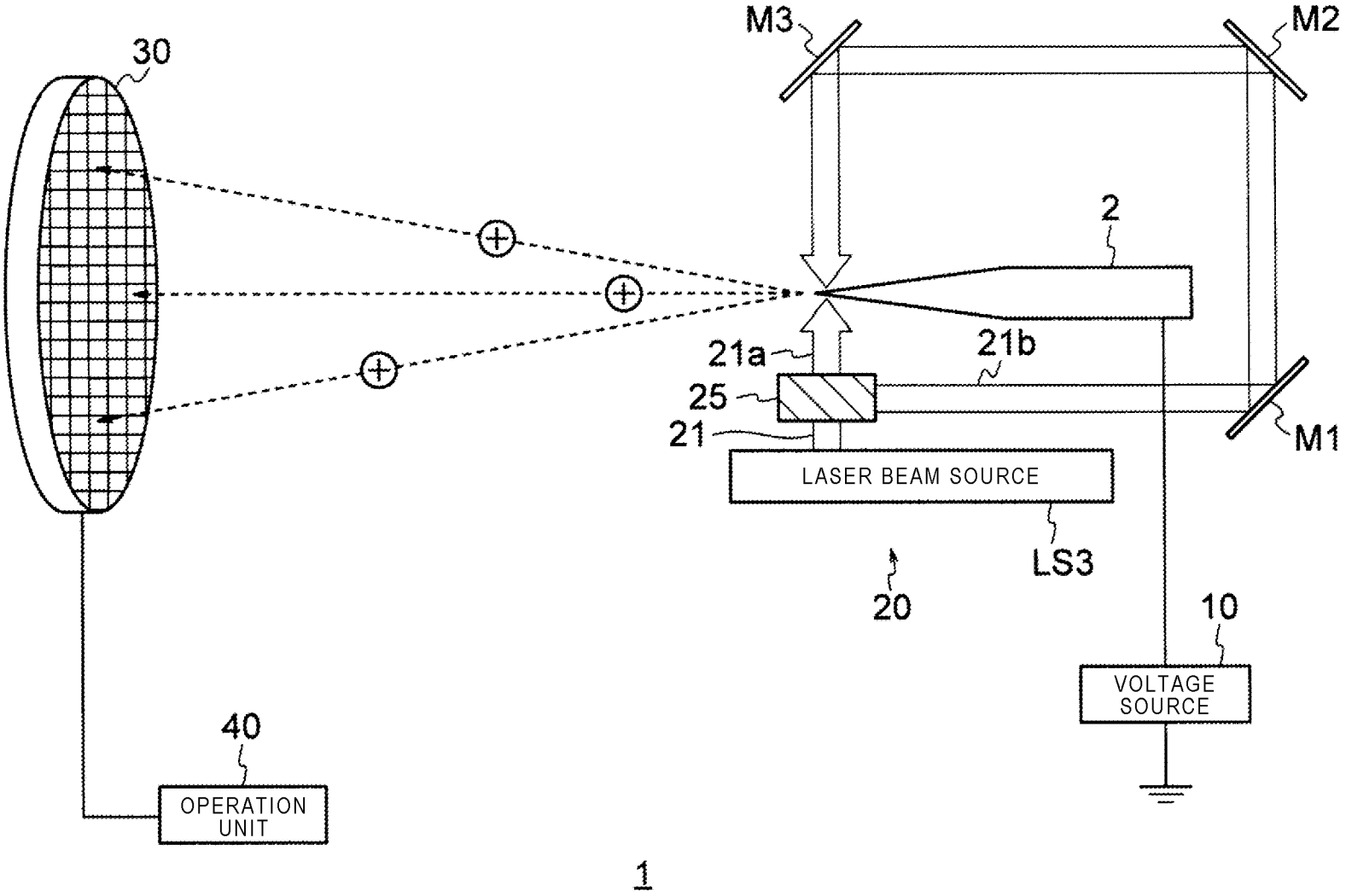
FIG. 12 is a conceptual diagram illustrating a configuration example of a probe device according to Modification Example 1 of the third embodiment.

FIG. 12 is a conceptual diagram illustrating a configuration example of a probe device 1 according to Modification Example 1 of the third embodiment. In the third embodiment, the plurality of laser beam sources may be provided. However, in Modification Example 1, a laser beam 21 from the same laser beam source LS3 may be divided into a plurality of laser beams 21*a* and 21*b*, and the sample 2 may be irradiated with the plurality of laser beams.

Referring to FIG. 12, a laser irradiation unit 20 according to Modification Example 1 includes at least one laser beam source LS3, a spectroscope 25, and mirrors M1 to M3. The laser beam source LS3 may generate a laser beam 21. The spectroscope 25 may divide the laser beam 21 into a plurality of laser beams 21*a* and 21*b*. The mirrors M1 to M3 as an optical system may guide the divided laser beam 21*b* and cause the sample 2 to be irradiated with the laser beams 21*a* and 21*b* from substantially symmetrical directions to each other. That is, the sample 2 may be irradiated with the laser beams 21*a* and 21*b* from both the sides of the sample 2.

The operation unit 40 may control the spectroscope 25 based on the number of ions detected by the detector 30 and the density of the ions, and change the ratio of light intensity between the plurality of divided laser beams 21*a* and 21*b*. That is, the operation unit 40 may perform feedback control of a spectral ratio in the spectroscope 25 based on the number of ions I1 and I2 detected by the detector 30 or the density thereof. Thus, in Modification Example 1, it is possible to obtain effects similar to those in the third embodiment.

Fourth Embodiment

Figure 13:
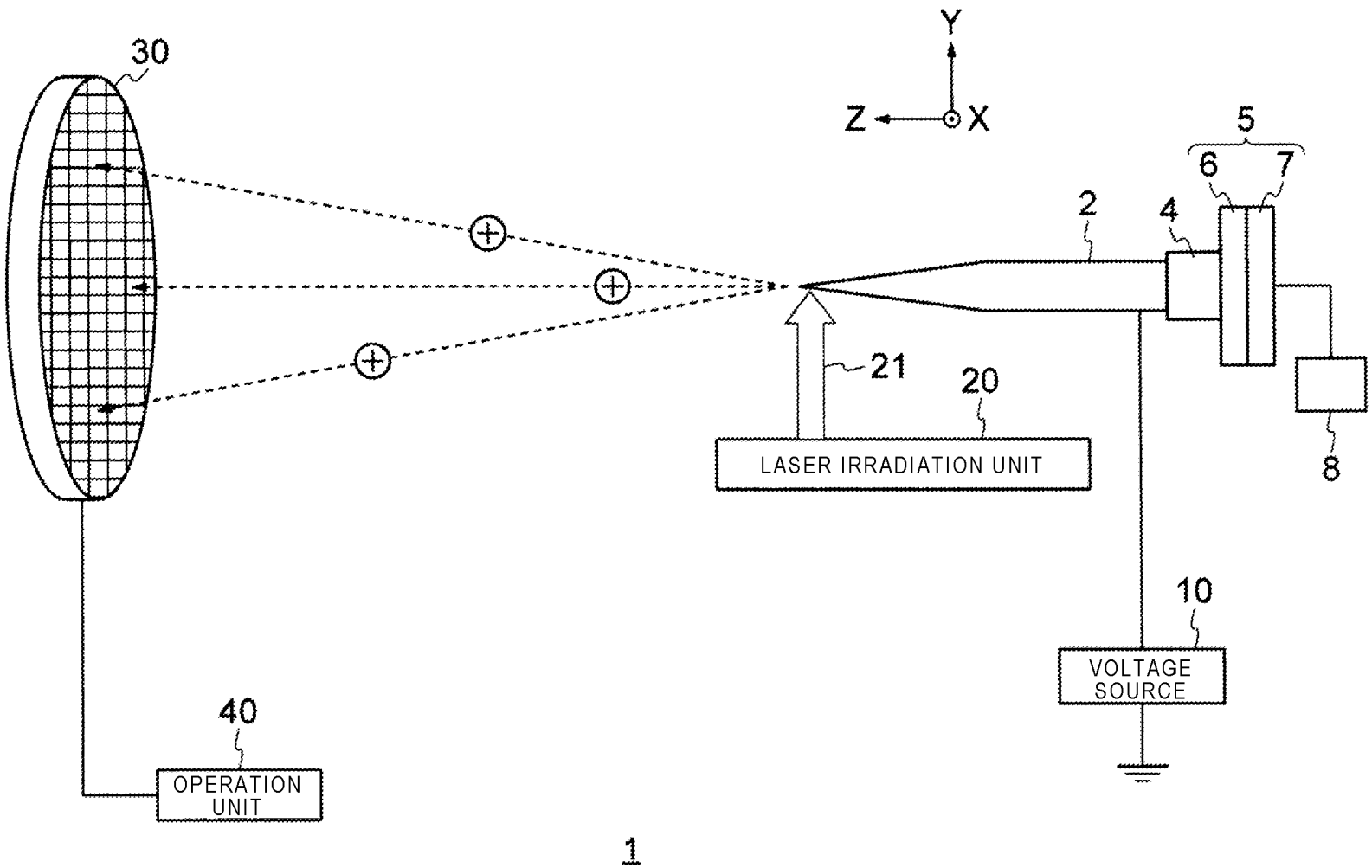
FIG. 13 is a conceptual diagram illustrating a configuration example of a sample analyzer according to a fourth embodiment.

FIG. 13 is a conceptual diagram illustrating a configuration example of a sample analyzer 1 according to a fourth embodiment. In the fourth embodiment, the sample analyzer may control a laser irradiation position for the sample 2 or a laser irradiation angle for the sample 2 based on model information which is prepared in advance and indicates the structure of the sample 2. The model information may be similar to that in the first embodiment.

The sample analyzer 1 according to the fourth embodiment may further include a sample holder 4, a sample stage 5, and a control unit 8. The sample holder 4 may be used for fixing the sample 2 and is attached to the sample stage 5.

The sample stage 5 as a driving unit may include a first driving unit 6 and a second driving unit 7. The first driving unit 6 may include a three-dimensional step motor driving by a piezoelectric element, for example, and thus can move the position of the sample holder 4, that is the position of the sample 2 in any of X, Y, and Z directions. The Z direction is a direction in which the tip portion of the sample 2 is directed (or direction of a center axis). The X and Y directions indicate orthogonal coordinates perpendicular to the Z direction.

The second driving unit 7 may be a motor that rotates the first driving unit 6 around a Z axis. The second driving unit 7 may further include a piezoelectric element for inclining an axial direction of the sample 2 from the Z axis. Although not illustrated, a mechanism that finely adjusts an optical path of the laser beam 21 may be provided in the laser irradiation unit 20.

The control unit 8 may control the first and second driving units 6 and 7 to adjust the position or the orientation of the sample 2.

In the fourth embodiment, the control unit 8 may move the sample 2, rotate the sample 2, or changes the orientation (or direction of the center axis or tilt angle) of the sample 2, and thus can determine an irradiation position of the laser beam 21 on the sample 2. For example, as described with reference to FIG. 14, the sample stage 5 can move the sample 2 such that the position or the orientation of an interface B between different materials of the sample 2 is set to be substantially parallel to the laser beam 21.

Figure 14:
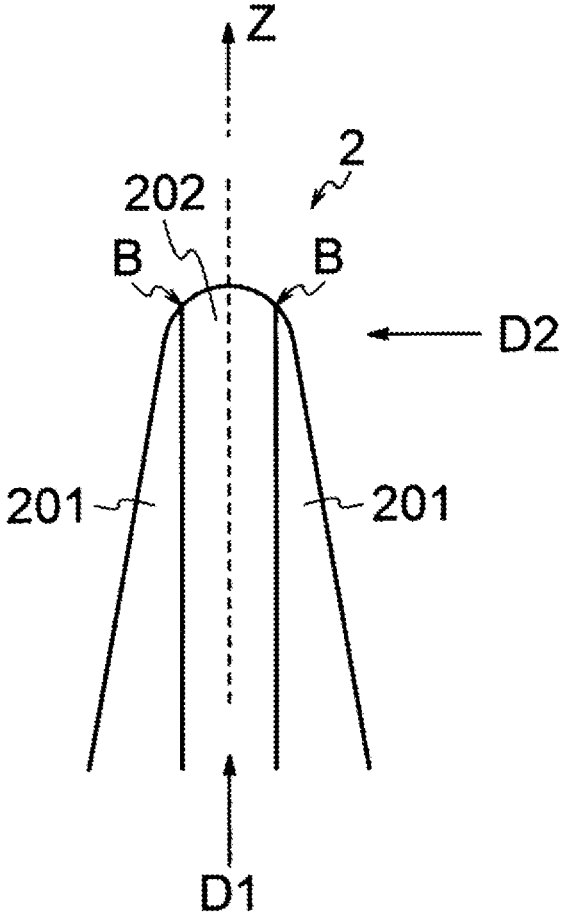
FIG. 14 is a diagram illustrating a configuration example of the tip portion of the sample.

FIG. 14 is a diagram illustrating a configuration example of the tip portion of the sample 2. The tip portion of the sample 2 may include a first material 201 and a second material 202. The second material 202 may be sandwiched by the first material 201. An interface B may be provided between the first material 201 and the second material 202.

In this case, the control unit 8 may control the sample stage 5 such that the laser beam 21 is incident to the sample 2 so as to be substantially parallel to the interface B. Thus, the sample 2 may be irradiated with the laser beam 21 from a direction D1 along the interface B. The direction D1 is a direction directed toward the sample 2 in a plane which is substantially parallel to the interface B. The direction D1 may be a direction (paper surface vertical direction in FIG. 14) which is substantially perpendicular to a Z-axis direction. However, the direction D1 may be inclined from the vertical direction to some extents so long as the direction is in a plane which is substantially parallel to the interface B.

Figure 15:
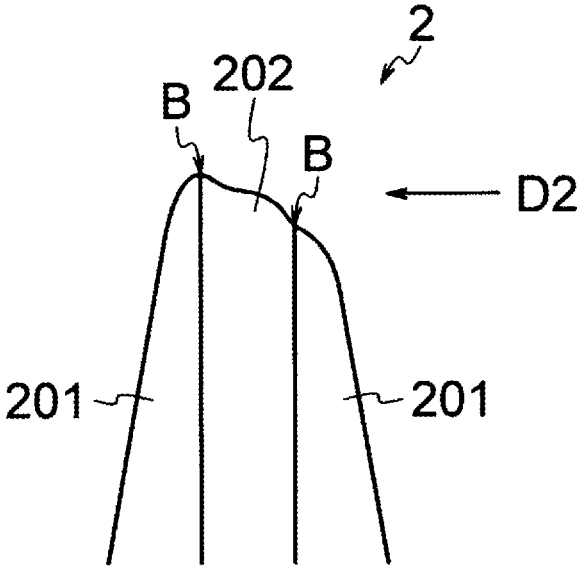
FIG. 15 is a diagram illustrating a tip portion of the sample when being irradiated with a laser beam from a direction D2.

FIG. 15 is a diagram illustrating the tip portion of the sample 2 when being irradiated with the laser beam 21 from a direction D2. As illustrated in FIG. 15, if the sample is irradiated with the laser beam 21 from the direction D2 perpendicular to the interface B, a side surface of the first material 201 may be irradiated with the laser beam 21, and thus the first material 201 may be mainly field-evaporated. In this case, field evaporation may occur from the first material 201 on one side. Thus, as illustrated in FIG. 15, the side surface of the first material 201 on the one side may be dented. Since the sample 2 deforms, the position and the shape of the interface, which are obtained by the operation unit 40 may be changed or distorted from those of the interface B in the original sample 2. The manner of changing the composition in the vicinity of the interface B, which is obtained by the operation unit 40, may also differ from that in the original sample 2.

In the fourth embodiment, the orientation of the interface B may be specified in advance by using the model information such as observation data, which is obtained by the microscope. In the probe device 1, the sample stage 5 may cause the position or the orientation of the sample 2 to be adjusted, and thus the sample 2 may be irradiated with the laser beam 21 from the direction D1 which is substantially parallel to the interface B of the sample 2. Thus, atoms may be field-evaporated from both the first and second materials 201 and 202, and thus the interface B may be clearly detected by the detector 30. Since the sample 2 is irradiated with the laser beam 21 to be substantially parallel to the interface B, even when the sample 2 locally deforms at the irradiation portion with the laser beam, the operation unit 40 can accurately obtain the position or the shape of the interface B. That is, according to the fourth embodiment, it is possible to reduce a negative effect (or local magnification effect) occurring due to local deformation of the sample 2 and to accurately analyze the material or the structure of the sample 2.

In a case where the model information is not provided, the probe device 1 may start mass spectrometry by irradiating the sample 2 with the laser beam 21 while changing the laser irradiation position or the laser irradiation angle. When the laser irradiation position or the laser irradiation angle which allows the interface B to be accurately detected are determined, the sample stage 5 may fix the position of the sample 2. Then, the probe device 1 may continue mass spectrometry in a state where the laser irradiation position or the laser irradiation angle is fixed. Even in this manner, it is possible to reduce the negative effect occurring by local deformation of the sample 2 and to accurately analyze the material or the structure of the sample 2.

The probe device 1 according to the fourth embodiment can accurately analyze the material or the structure of the sample 2 by irradiating the sample 2 with the laser beam 21 from the direction suitable for the structure of the sample 2. The fourth embodiment may be combined with any of the first to third embodiments or the modification example. Thus, in the fourth embodiment, it is possible to obtain the effects of any of the first to third embodiments and the modification example together.

Figure 16:
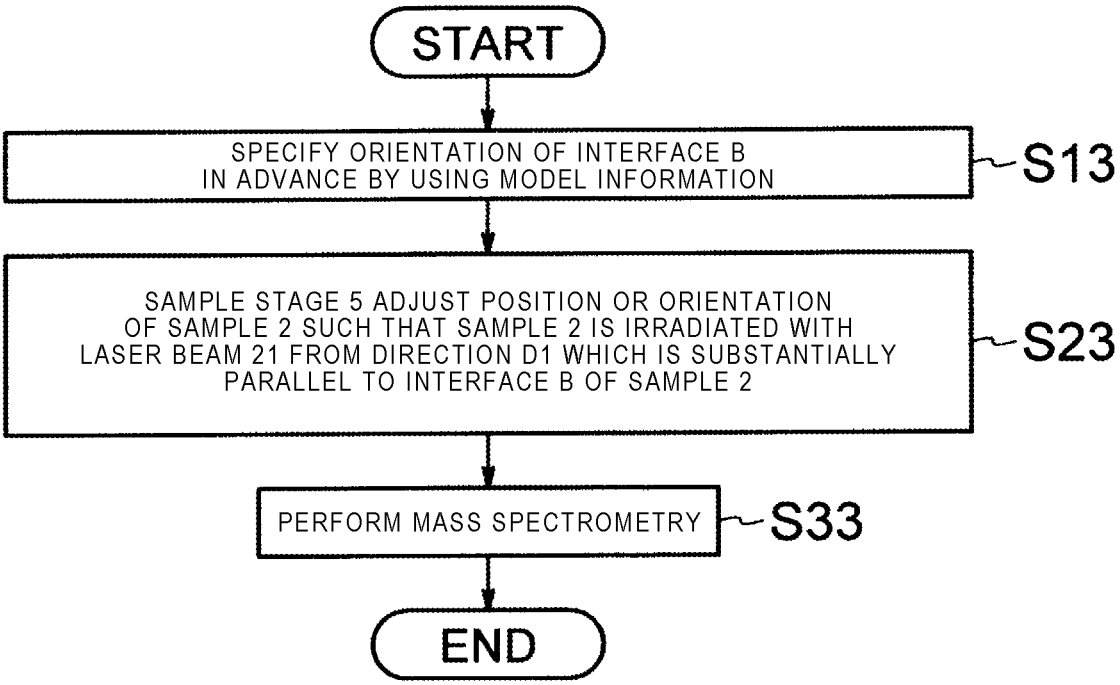
FIG. 16 is a flowchart illustrating a sample analysis method according to the fourth embodiment.

FIG. 16 is a flowchart illustrating a sample analysis method according to the fourth embodiment. Firstly, the orientation of the interface B may be specified in advance by using model information (S13). Then, the sample stage 5 may adjust the position or the orientation of the sample 2 such that the sample is irradiated with the laser beam 21 from the direction D1 which is substantially parallel to the interface B of the sample 2 (S23). Then, the laser irradiation unit 20 may irradiate the sample 2 with the laser beam 21 so as to perform mass spectrometry (S33).

MODIFICATION EXAMPLE 2

Figure 17:
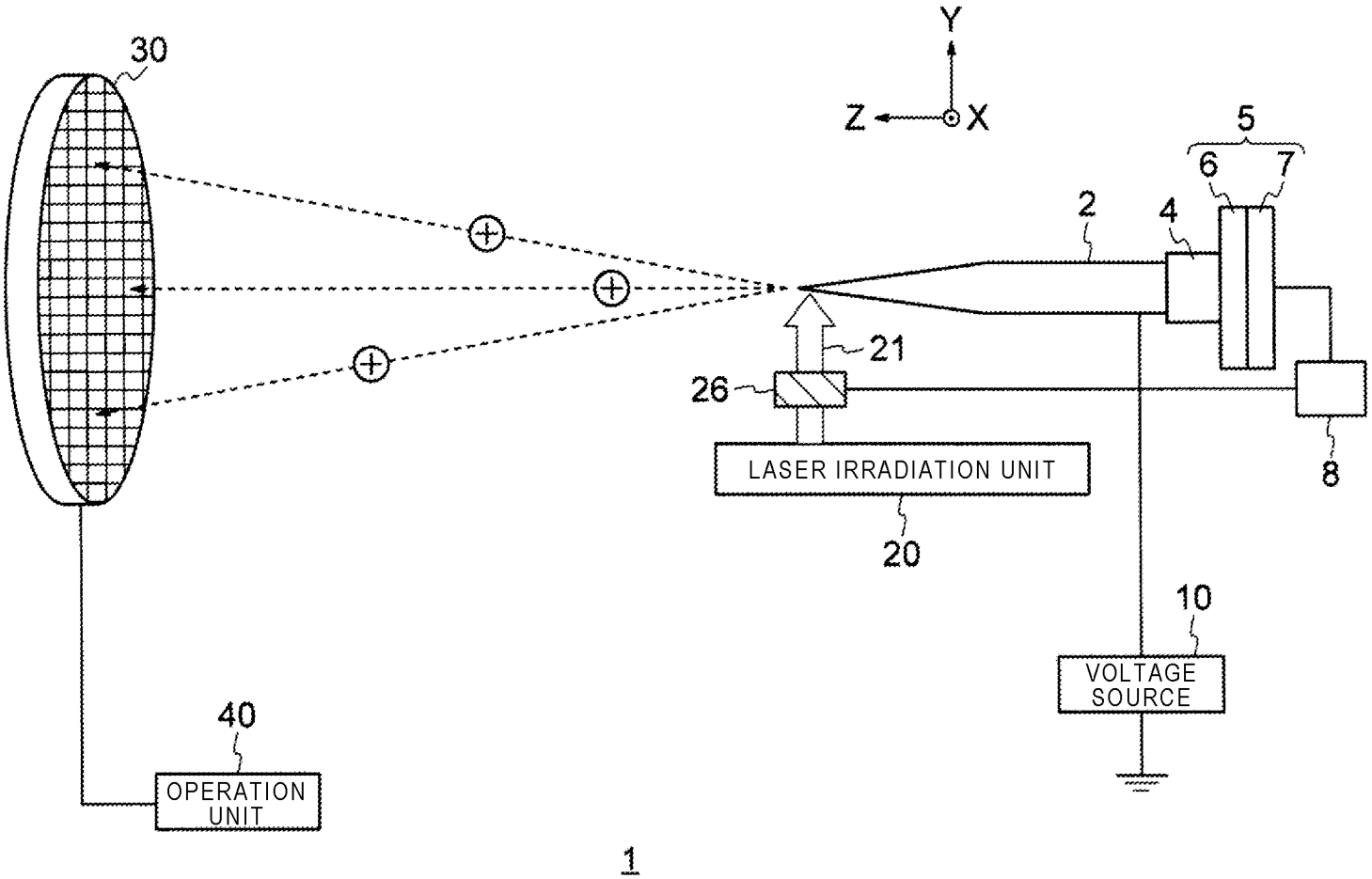
FIG. 17 is a conceptual diagram illustrating a configuration example of a probe device according to Modification Example 2 of the fourth embodiment.

FIG. 17 is a conceptual diagram illustrating a configuration example of a probe device 1 according to Modification Example 2 of the fourth embodiment. In the fourth embodiment, the irradiation position of the laser beam 21 on the sample 2 may be adjusted by controlling the sample stage 5 to change the position or the orientation of the sample 2.

On the contrary, the probe device 1 according to Modification Example 2 may further include an adjustment unit 26 that adjusts the position or the angle of laser irradiation with the laser beam 21. Other components in Modification Example 2 may be similar to the corresponding components in the fourth embodiment. Thus, according to Modification Example 2, it is possible to obtain effects similar to those in the fourth embodiment. In Modification Example 2, either or both of the first driving unit 6 and the second driving unit 7 may be omitted.

The irradiation direction of the laser beam 21 on the sample 2 may be adjusted similar to the fourth embodiment. Further, the adjustment unit 26 can finely adjust the irradiation angle of the laser beam 21. Thus, in Modification Example 2, the sample 2 can be irradiated with the laser beam 21 in more various directions than that in the fourth embodiment. Thus, in Modification Example 2, it is possible to reduce the negative effect occurring by local deformation of the sample 2 and to accurately analyze the material or the structure of the sample 2.

At least a portion of the sample analysis method according to the above embodiments may be configured with hardware or be configured with software. In a case where the portion of the sample analysis method is configured with software, a program implementing the function of at least a portion of the sample analysis method may be stored in a recording medium such as a flexible disk or a CD-ROM, may be read in a computer, and may be executed. The recording medium is not limited to a detachable medium such as a magnetic disk and an optical disk and may be a fixed type recording medium such as a hard disk device or a memory. The program implementing the function of at least a portion of the sample analysis method may be distributed via a communication line (also including a wireless communication) such as the Internet. The program may be encrypted or modulated. The program may be stored in a recording medium and be distributed over a wired line such as the Internet or a wireless line or stored in a recording medium for distribution.

While certain embodiments have been described, these embodiments have been presented byway of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A sample analyzer comprising:

a voltage source that applies a voltage to a sample;

a laser irradiator that irradiates the sample with a laser beam;

a detector that detects a particle emitted from the sample; and an operation device that specifies a material of the particle detected by the detector, by mass spectrometry of the particle and analyzes a structure of the sample, wherein the operation device calculates a ratio in structure between model information indicating the structure of the sample, which is prepared in advance, and analysis information indicating the structure of the sample, which is obtained by the mass spectrometry, and applies the ratio to the analysis information so as to correct the analysis information.

2. The sample analyzer according to claim 1, wherein the model information includes design data of the sample or observation data of the sample, which is obtained by using at least one of a scanning electron microscope (SEM), a transmission electron microscope (TEM), a scanning transmission electron microscope (STEM), a scanning ion microscope (SIM), or a scanning probe microscope (SPM).

3. The sample analyzer according to claim 1, wherein the model information includes information estimated by using a field evaporation simulation with respect to the observation data of the sample, which is obtained by using at least one of the scanning electron microscope (SEM), the transmission electron microscope (TEM), the scanning transmission electron microscope (STEM), the scanning ion microscope (SIM), or the scanning probe microscope (SPM).

4. The sample analyzer according to claim 1, wherein the operation device corrects the analysis information by multiplying the analysis information by the ratio.

5. The sample analyzer according to claim 1, wherein the operation device calculates a first distance between a first equal density surface and a second equal density surface of an element or an ion type in the model information, calculates a second distance between a third equal density surface and a fourth equal density surface of the element or the ion type in the analysis information, and sets a ratio between the first distance and the second distance to be the ratio between the model information and the analysis information.

6. The sample analyzer according to claim 1, wherein the operation device calculates a first distance between a first change surface and a second change surface on which an element or an ion type changes in the model information, calculates a second distance between a third change surface and a fourth change surface on which the element or the ion type changes in the analysis information, and sets a ratio between the first distance and the second distance to be the ratio between the model information and the analysis information.

7. The sample analyzer according to claim 1,
wherein the operation device virtually divides the sample into a plurality of blocks in the model information and the analysis information and calculates the ratio for each of the plurality of blocks.

8. A sample analyzer comprising:
a voltage source that applies a voltage to a sample;
a laser irradiator that irradiates the sample with laser;
a detector that detects a particle emitted from the sample; and
an operation device that specifies a material of the particle detected by the detector, by mass spectrometry of the particle and analyzes a structure of the sample,
wherein the operation device changes an output of the laser irradiator based on a number of particles detected by the detector or density of the particles.

9. The sample analyzer according to claim 8,
wherein the laser irradiator includes a first laser irradiator that irradiates a first detection region of the sample, and a second laser irradiator that irradiates a second detection region of the sample, and
the operation device
detects a first number or first density of particles in the first detection region of the sample,
detects a second number or second density of particles in the second detection region of the sample, and
changes an output of the first laser irradiator and an output of the second laser irradiator based on the first number or first density of particles in the first detection region and the second number or second density of particles in the second detection region.

10. The sample analyzer according to claim 9,
wherein the operation device
compares the first number or first density of particles in the first detection region and the second number or second density of particles in the second detection region, and
changes the output of the first irradiator and the output of the second laser irradiator based on a result of the comparison.

11. The sample analyzer according to claim 10,
wherein the operation device adjusts, when it is determined that the first number or first density of particles in the first detection region is equal to the second number or second density of particles in the second detection region, both of the outputs of the first and second irradiators without changing an output ratio between the first irradiator and the second irradiator.

12. The sample analyzer according to claim 10,
wherein when it is determined that the first number or first density of particles in the first detection region is greater than the second number or second density of particles in the second detection region, the operation device increases the second number or second density of particles in the second detection region or decreases the first number or first density of particles in the first detection region.

13. A sample analyzer comprising:
a voltage source that applies a voltage to a sample;
a laser irradiator that irradiates the sample with laser;
a detector that detects a particle emitted from the sample; and
an operation device that specifies a material of the particle detected by detector, by mass spectrometry of the particle, and analyzes a structure of the sample,
wherein the operation device changes a laser irradiation position or a laser irradiation angle for the sample based on model information indicating a structure of the sample, which is prepared in advance,
wherein the sample includes a first material and a second material between which an interface is provided, and
the operation device changes the laser irradiation position or the laser irradiation angle such that the sample is irradiated from a direction parallel to the interface of the sample.

14. The sample analyzer according to claim 13, further comprising a sample stage to which the sample is attached,
wherein the operation device changes the laser irradiation position or the laser irradiation angle by controlling the sample stage to change a position or an orientation of the sample.

* * * * *